US005432972A

United States Patent [19]

Polzin et al.

[11] Patent Number: 5,432,972

[45] Date of Patent: Jul. 18, 1995

[54] PAD-TYPE CORNER PAINTING TOOL

[75] Inventors: Bruce C. Polzin, Greendale; Robert A. Shaffer, Kenosha, both of Wis.; Robert A. O'Neil, Glen Ellyn, Ill.; Robert A. Chieda, Wheaton, Ill.; Leon C. Clouser, Lombard, Ill.

[73] Assignee: Newell Operating Company, Freeport, Ill.

[21] Appl. No.: 163,207

[22] Filed: Dec. 6, 1993

Related U.S. Application Data

[63] Continuation-in-part of Ser. No. 752,061, Aug. 29, 1991, Pat. No. 5,267,369.

[51] Int. Cl.[6] ..... B05C 17/00

[52] U.S. Cl. ..... 15/210.1; 15/244.1; 15/160

[58] Field of Search ..... 15/210.1, 244.1, 244.2, 15/235.7, 160, 235.8

[56] References Cited

U.S. PATENT DOCUMENTS

| | | | |
|---|---|---|---|
| 2,678,458 | 5/1954 | Vosbikian et al. | 15/244.2 |
| 3,051,977 | 9/1962 | Pamphilis | 15/210.1 |
| 3,106,736 | 10/1963 | Knapp | 15/244.2 |
| 3,464,079 | 9/1969 | Palmeri | 15/210.1 |
| 3,713,744 | 1/1973 | Sims | 15/210.1 X |
| 3,728,755 | 4/1973 | Whalen | 15/210.1 |
| 4,554,699 | 11/1985 | Simmons | 15/201 |
| 4,631,019 | 12/1986 | House | 15/235.8 X |
| 4,674,144 | 6/1987 | Palmeri | 15/210.1 |
| 4,729,143 | 3/1988 | Dawson | 15/210.1 |
| 5,131,111 | 7/1992 | Richardson et al. | 15/244.1 X |

FOREIGN PATENT DOCUMENTS

| | | | |
|---|---|---|---|
| 839452 | 6/1960 | United Kingdom | 15/235.7 |

*Primary Examiner*—David A. Scherbel
*Assistant Examiner*—Patrick F. Brinson
*Attorney, Agent, or Firm*—Baker & McKenzie

[57] ABSTRACT

An improved paint pad assembly is provided with a painting surface contour that is changeable from concave to flat to convex so that the paint pad can paint exterior corners, flat surfaces and interior corners with equal ease. The one-piece paint pad features handpieces disposed on the opposing edges of the paint pad. The two-piece embodiment features an inverted U-shaped handle mounted to the opposing side edges of the paint pad via a tab and lock configuration. The paint pad is hinged in the longitudinal direction thereby enabling the pad surface to extend outwardly for painting an interior corner and inwardly for painting an exterior corner with equal ease.

14 Claims, 4 Drawing Sheets

PAD-TYPE CORNER PAINTING TOOL

This application is a continuation-in-part of application Ser. No. 07/752,061 filed on Aug. 29, 1991, now U.S. Pat. No. 5,267,369, issued on Dec. 7, 1993.

FIELD OF THE INVENTION

This invention relates generally to paint applicators and specifically to a paint pad which can apply paint to flat surfaces, inside corners and outside corners by simply altering the shape of the pad during use by novel hand applied pressure.

BACKGROUND OF THE INVENTION

Paint pads are becoming increasingly popular for applying paint due to a number of factors, including the evenness with which a layer of paint or other coating can be applied on flat surfaces. Such pads can also bring paint very close to an interior corner formed by two meeting surfaces or planes. But, to date, a good system for applying a very even coating to such interior junctions or corners has not appeared on the market in a paint pad which can paint flat surfaces and such interior corners with equal ease. Likewise, a paint pad which can paint exterior corners and flat surfaces with equal facility has not been known.

A number of proposals have been made for paint pads which address these tasks but none can be described as having achieved general acceptance in the sense that the same pad may be used during one painting job for painting flat surfaces, interior corners and exterior corners. Attempts by prior art workers to achieve one or more of these painting conditions are illustrated in U.S. Pat. Nos. 3,464,079, 3,713,744, 3,728,755, 3,051,977 and 4,674,144. Of the products illustrated in said patents, the '079 and '144 patents show pads useful for painting exterior corners only, and the '744 and '755 and '977 patents disclose applicators which are incapable of painting exterior corners. Of particular significance is that none of the devices of the above prior art are capable of reorientation during use in the sense of adaptation to a different painting condition from paint loading to paint loading without breaking the rhythm of the paint applicator user. Further, none of the known prior devices are applicable to surface junctions having angles greater or lesser than a right angle, as well as right angle junctions.

Thus, a need exists for a pad-type universal paint applicator which can apply paint or other coating to flat surfaces, interior corners and exterior corners with equal facility by using only hand applied pressure exerted on the paint applicator during the painting operation so that the painting rhythm of the user is uninterrupted.

SUMMARY OF THE INVENTION

The invention is a pad-type paint or coating applicator whose physical contour may be changed by novel hand pressure applied to the applicator during a painting operation so that such diverse painting environments as an interior corner, a flat surface, an exterior corner, and all angular relationships therebetween, can be efficiently painted in successive paint applications (if need be) without breaking the painting rhythm of the user. The applicator of this invention is easy to load with paint, particularly as contrasted to the fixed angle configurations of prior devices. Further, the pad-type applicator of this invention does not require special fixturing to shape or glue pre-cut pad elements to conform to any fixed profile. In addition, the present applicator includes an easily reproducible pad element which results in better user value and convenience.

In summary, the paint applicator of the present invention provides a neat, low cost, easy to use pad-type paint applicator which is universally adaptable during use to paint contours which range from 90° interior corners to 90° exterior corners, and even somewhat beyond those limits, as well as all angles in between.

The pad-type universal paint applicator of this invention is essentially a tool consisting of a pad assembly composed of a flexible foam element having fibers bonded on its working surface and a unique backing on its opposed surface, the backing having a hinge which extends its length and thereby enables the backing to flex from one extreme angle of use to an opposite extreme angle of use. The pad assembly may be made by designing the hinge area of the backing with a living hinge or a mechanical hinge. The preferred embodiment uses a bi-component plastic extrusion wherein the hinge area is made with a softer, more flexible material than the parts of the backing which flank it, thus forming a living hinge.

Two types of handles are available. One type includes two opposing handpieces that are attached to the backing. The handpieces may be integrally molded with the handpieces or attached separately.

A second type of handle includes a one-piece, inverted U-shaped handle with ends attached to the opposing sides of the backing with a tab arrangement. The tabs, preferably projecting from the outer side edges of the stiff backing, attach the pad in a loose, "floating", yet secure relationship to a one-piece handle. The handle in turn has a hinge area extending its length which is similar to the hinge area of the pad assembly, the two hinge areas being essentially parallel and in alignment but vertically offset from each other.

By exerting hand applied pressure to the handle the hinge area of the pad assembly can be caused to move in a "closing" direction which will cause the pad assembly to form an angle of less than 180° whereby the contour of the pad assembly takes a shape which enables the pad assembly to conform exactly to the angular contour of a corner junction having an included angle of less than 180°, such as but not limited to an interior right angle. The exact angle required is achieved by varying the degree of squeeze pressure exerted on the sides of the handle. No significant level of skill is required to attain the exact angle. Most users will instinctively conform the handle to the proper angle at the first use. The pad assembly can be caused to conform exactly to a corner junction having an included angle of more than 180°, such as but not limited to an exterior right angle, by merely pressing the pad loaded with paint against the exterior corner.

BRIEF DESCRIPTION OF THE DRAWINGS

The invention is illustrated more or less diagrammatically in the accompanying drawings wherein.

Figure 1:
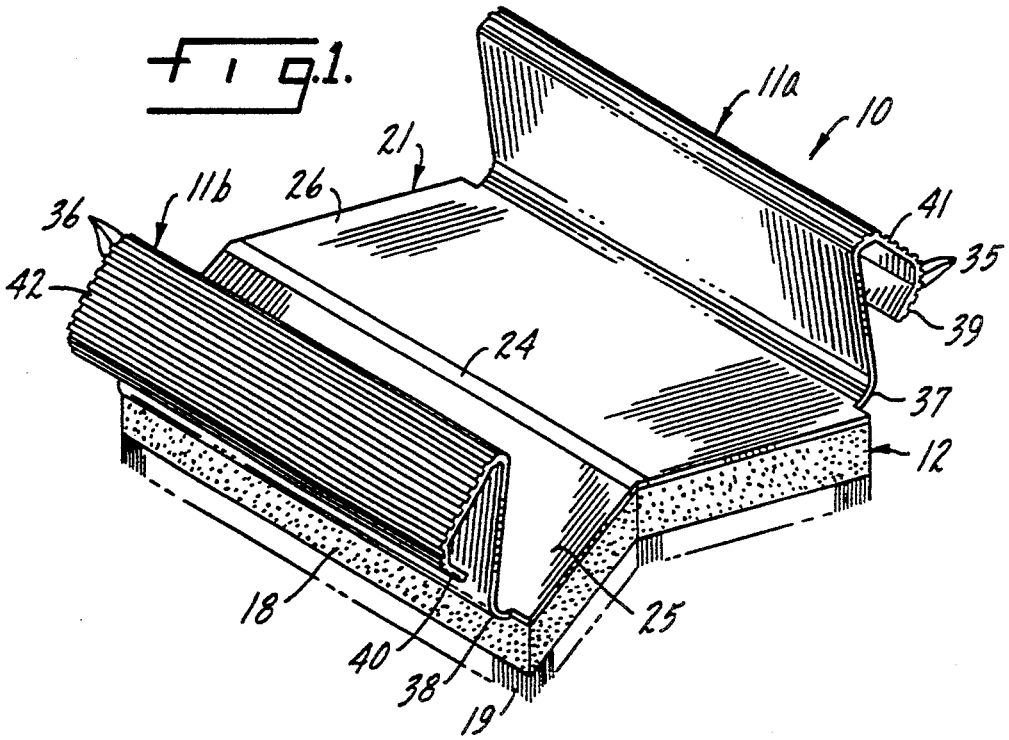
FIG. 1 is a perspective view of one embodiment of the improved pad-type painting tool of the present invention in a position suitable for painting a flat surface.
Figure 2:
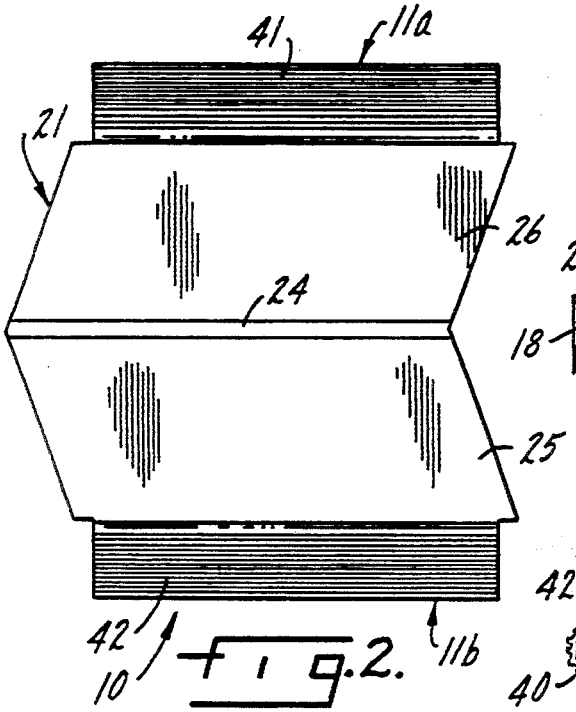
FIG. 2 is a top plan view of the pad-type painting tool of FIG. 1.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which were under other details difficult to perceive may be omitted. It should be understood, of course, that the invention is not necessarily limited to the particular embodiments illustrated herein.

DETAILED DESCRIPTION OF THE FIGURES

Like reference numerals will be used to refer to like parts from figure to figure in the following description of the drawings.

The pad-type painting tool of the present invention is provided in two embodiments indicated generally at 10 in FIGS. 1–8 and generally at 110 in FIGS. 9–17. The improved pad-type painting tool 10, 110 provide illustrative examples of the pad-type painting tools that fall within the scope of the present invention. After reading the description below, it will become apparent to those skilled in the art that modifications may be made to either embodiment 10 or 110 without departing from the spirit and scope of the present invention.

As noted above, one improved pad-type painting tool of the present invention is indicated generally at 10 in FIG. 1. It includes a two-piece handle indicated generally at 11*a* and 11*b*. The handles or handpieces 11*a*, 11*b* are connected directly to the backing 21 or may be connected via the tab arrangement illustrated in FIGS. 9–17. The pad-type painting tool 10 also includes a pad assembly, indicated generally at 12.

Figure 3:
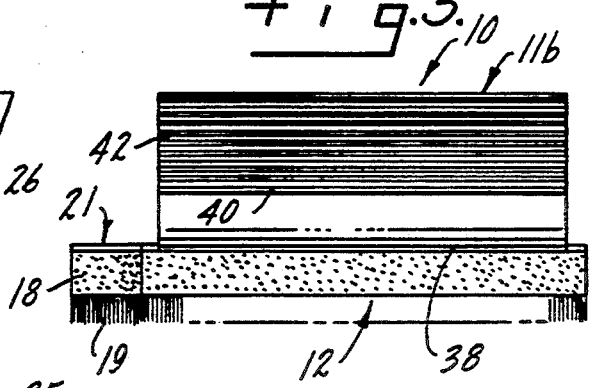
FIG. 3 is a side view of the pad-type painting tool of FIG. 1.
Figure 4:
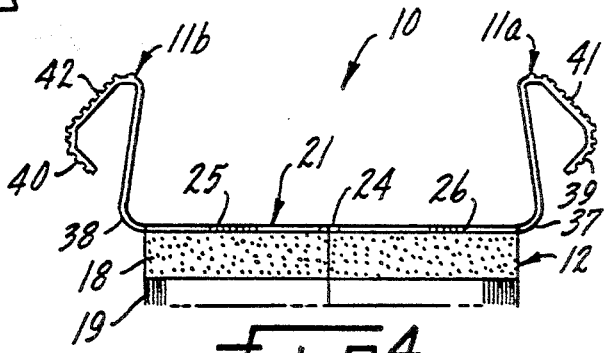
FIG. 4 is an end view of the pad-type painting tool of FIG. 1 in a position suitable for painting a flat surface.
Figure 13:
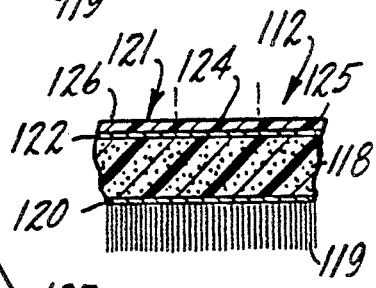
FIG. 13 is a section to an enlarged scale taken substantially along the line 13—13 of FIG. 11.

Referring now to FIGS. 1–4 collectively, and initially primarily to FIG. 4, the pad assembly 12 includes a flexible foam element 18. Fibers 19 are bonded to the lower major surface of the foam element 18 by any suitable means such as an adhesive 120 as illustrated in FIG. 13. The backing 21 is stiffer than the foam element 18 and may also be bonded to the foam element 18 by an adhesive such as 122 as shown in FIG. 13. The backing 21 includes a central hinge area 24 extending along the length of the backing. A pair of stiffer side members 25, 26 extend outwardly from the longitudinal edges of the hinge area 24. The hinge 24 may be made using the well known plastic "living hinge" concept or may be a mechanical hinge. The backing 21 may be a bicomponent plastic extrusion wherein the hinge area 24 is made from a softer material than the side members 25, 26. The backing 21 may also be a single component plastic extrusion wherein the hinge area 24 is thinner than the side members 25, 26.

The handpieces 11*a*, 11*b* are not connected and obviously do not include a hinge area like the one shown at 130 in FIGS. 9–17. However, the handpieces 11*a*, 11*b* include the textured or rib areas 35, 36 to provide an improved gripping surface for the user's fingers. The lowermost portions 37, 38 of the handpieces 11*a*, 11*b* are connected to the side members 25, 26 of the backing 21, respectively. As noted above, the handpieces 11*a*, 11*b* may be extruded with the backing 21 or may be separately attached mechanically like the handle 111 illustrated in FIGS. 9–17.

In operation, the fibers 19 of the pad assembly 12 are loaded by gently floating the pad assembly 12 on the surface of paint in a container such as a tray of sufficient area and then wiping off the excess paint on the tray edges. The loading mode of the pad assembly 12 is substantially flat, as shown in FIGS. 1 and 3, to permit easy, efficient paint loading.

Figure 5:
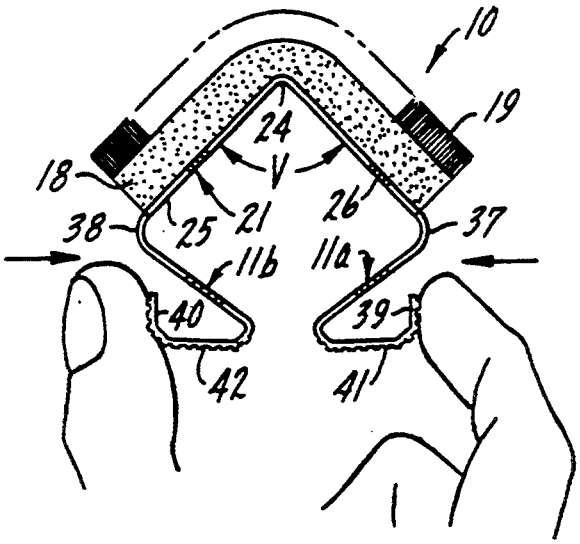
FIG. 5 is an end view of the pad-type painting tool of FIG. 1 after the handle has been flexed to cause the pad assembly to conform to an interior corner junction.
Figure 6:
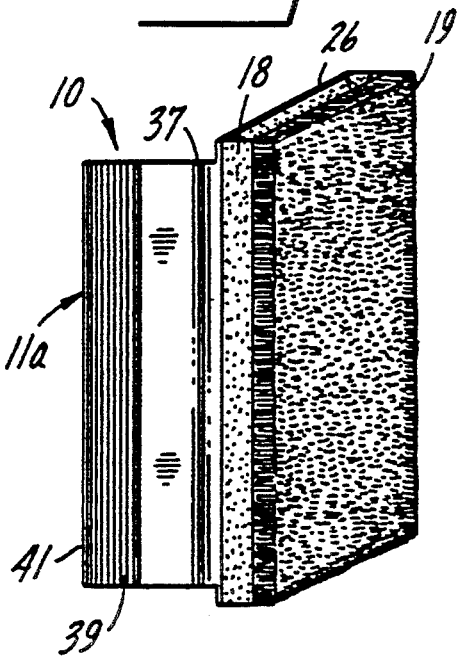
FIG. 6 is a side view of the pad-type painting tool of FIG. 1 as it appears when operated to paint an interior corner junction as shown in FIG. 5.

To apply paint to the inside, that is, an interior, corner area, the handpieces 11*a*, 11*b* are grasped by the rib areas 35, 36 and squeezed inwardly together as shown by the arrows in FIG. 5. Simultaneously, the user may press downward or outward on the hinge area 24 of the backing 21 to insure that the pad element bends outward as shown in FIG. 5. At this point, the loaded tool can then be used to apply paint to an inside, 2-plane corner. By squeezing more or less, the pad structure angle V, can be varied to fit the specific corner to be painted. The paint application is then accomplished by sliding the contacting tool 10 back and forth along the corner junction (not shown). The exterior skirts indicated at 39, 40 of the handpieces 11*a*, 11*b* respectively, provide convenient areas for the fingers to squeeze inwardly in the direction of the arrows as shown in FIG. 5.

Figure 7:
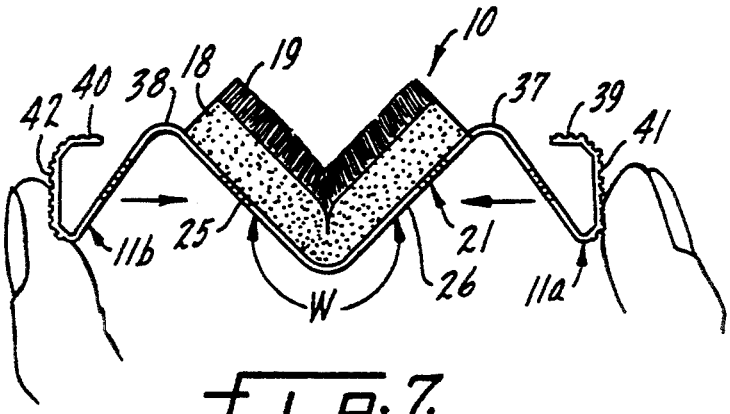
FIG. 7 is an end view of the pad-type painting tool of FIG. 1 after the handle has been flexed to cause the pad assembly to conform to an exterior corner junction.
Figure 8:
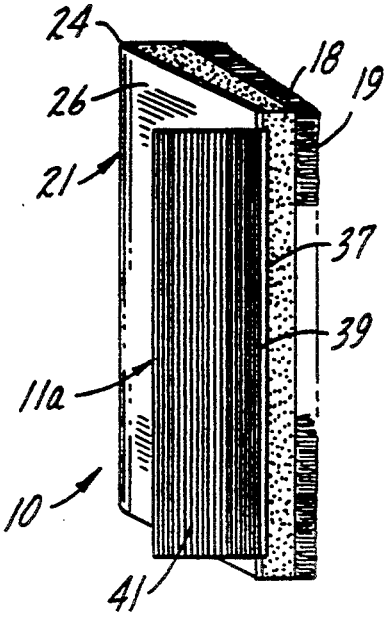
FIG. 8 is a side view of the pad-type painting tool of FIG. 1 as it appears when operated to paint an exterior corner junction as shown in FIG. 7.

To apply paint to an outside 2-plane corner area, that is an exterior corner, the center of the pad assembly 12, which has been loaded with paint, is pressed against the outside corner of the structure and the flanges 41, 42 of the handpieces 11*a*, 11*b* are squeezed inwardly in the direction of the arrows as shown in FIG. 7. By squeezing more or less, the pad structure angle W can be varied to fit the specific exterior corner to be painted. Again, paint application is accomplished by sliding the contracting tool back and forth along the corner junction with the parts of the tool 10 in the position shown in FIG. 7.

To paint a flat surface, the paint applicator 10 is used in the condition illustrated in FIGS. 1, 3 and 4 without the application of the squeezing pressure on the outer skirts 39, 40 or flanges 41, 42 of the handpieces 11*a*, 11*b*.

Figure 9:
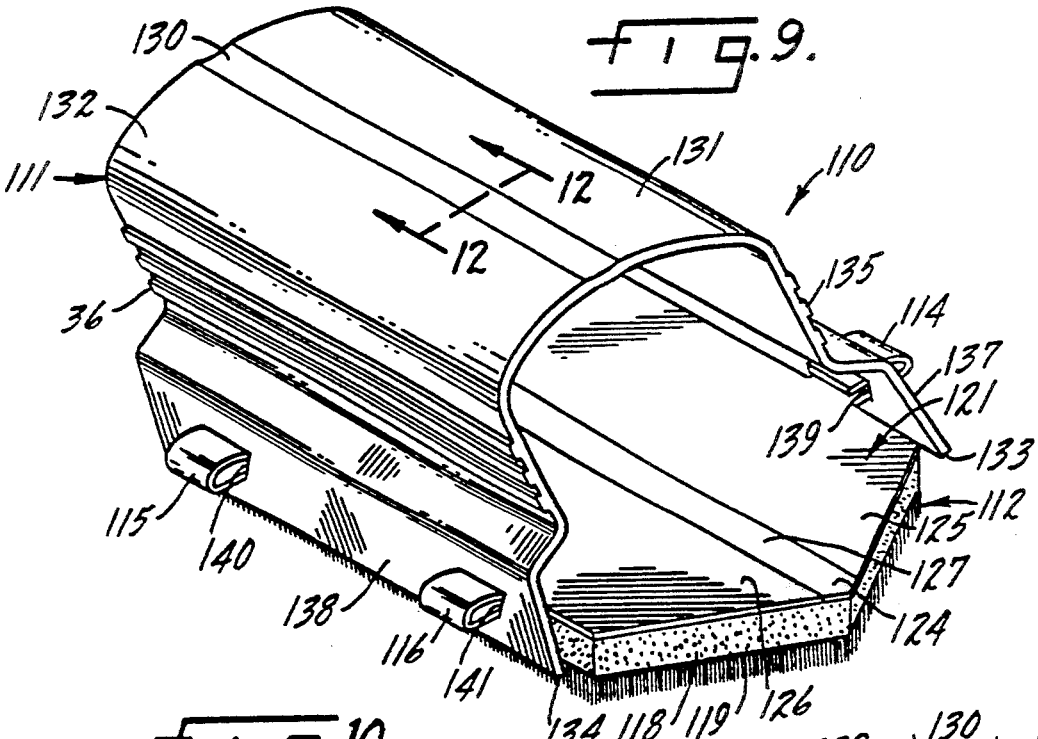
FIG. 9 is a perspective view of an alternative embodiment of the improved pad-type painting tool of this invention in a position suitable for painting a flat surface.

A second embodiment of the pad-type painting tool of the invention is indicated generally at 110 in FIG. 9. It includes a handle, indicated generally at 111, and a pad assembly, indicated generally at 112. The pad assembly is mechanically connected to the handle 111 by means of tabs, indicated generally at 113, 114, 115 and 116, which will be described in detail hereinafter.

Referring now to FIGS. 9–13, and initially primarily to FIG. 13, pad assembly 112 includes a flexible foam element 118. Fibers 119 are bonded to the lower major surface of foam element 118 by any suitable means such as adhesive 120. A backing, which is stiffer than the foam element 118, is indicated generally at 121. The backing 121 is bonded to the foam element 118 by any suitable means such as adhesive 122.

The backing 121 includes a central hinge area, indicated at 124, extending along its length. A pair of stiffer side members which extend outwardly from the longitudinal edge of hinge area 124 are indicated at 125, 126. The hinge 124 may be made by using the well known plastic "living hinge", or it may be a mechanical hinge. The backing 121 may be a bicomponent plastic extrusion wherein the hinge area 124 is made with a softer material than the side members 125, 126 or the backing 121 may be a single component extrusion where the hinge 124 is thinner than the side members 125, 126. A pressure area on the hinge near its front end is indicated at 127 in FIG. 9 for a purpose which will appear hereinafter.

Figure 10:
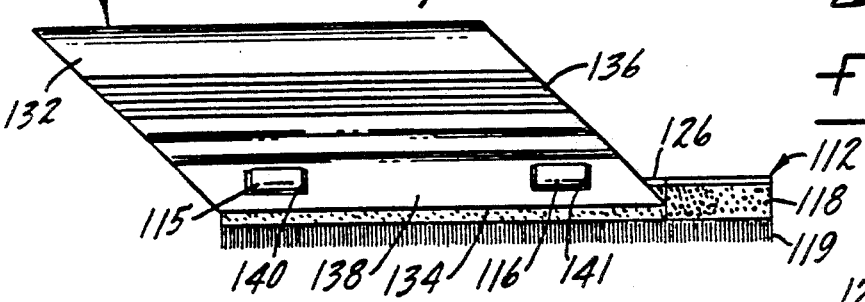
FIG. 10 is a side view of the improved pad-type painting tool of FIG. 9.
Figure 12:
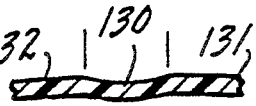
FIG. 12 is a section to an enlarged scale taken substantially along the line 12—12 of FIG. 9.
Figure 11:
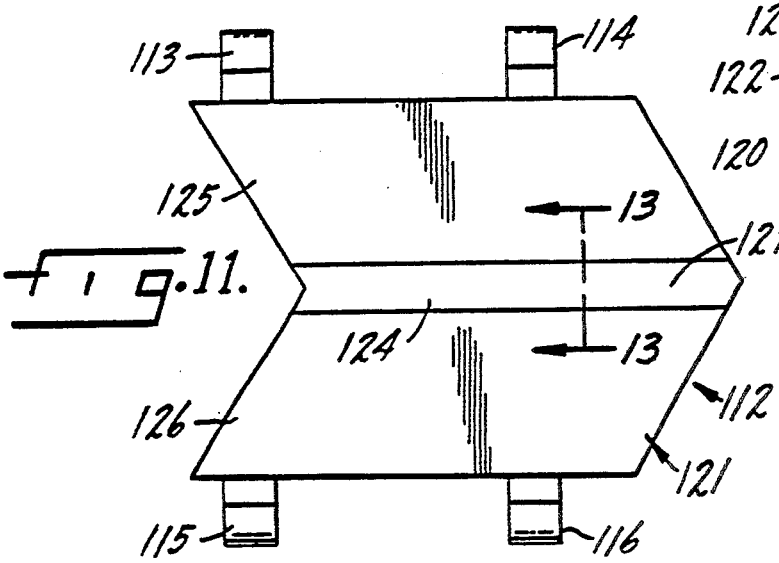
FIG. 11 is a top plan view of the pad assembly of the pad-type painting tool of FIG. 9.

The unitary handle 111 also has a central hinge area 130 extending along its length which is made similar to hinge area 124. Left and right handle side members 131, 132 extend outwardly from hinge 130 and terminate at bottom edges 133, 134 which, as best seen in FIG. 10, are spaced well above the bottom ends of fibers 119 in an unflexed condition of the tool. Textured or ribbed areas 135, 136 are formed on the exterior sides of the left and right sides 131, 132 of the handle to provide a gripping surface for the user's fingers. The lowermost skirt portions 137, 138 of the handle side members are apertured as at 139, 140 and 141 to receive tabs 114, 115 and 116 which project outwardly from the side members 125, 126 of the pad assembly. The tabs are, in effect, merely continuous strips which extend outwardly from the stiff side members 125, 126 and are bent backwardly so that they need be compressed slightly to be received in the apertures 139–141 and the left rear aperture, not shown.

In operation, the tool 110 is operated in a manner similar to the tool 10 as described in connection with FIGS. 1–8 above. The fibers 119 of the pad assembly 112 are loaded by gently floating the pad assembly 112 on the surface of paint in a container such as a tray of sufficient area and then wiping off excess paint on the tray edges. In the loading mode the pad assembly 112 is substantially flat, as shown in FIGS. 9 and 10, to permit easy, efficient paint loading.

Figure 14:
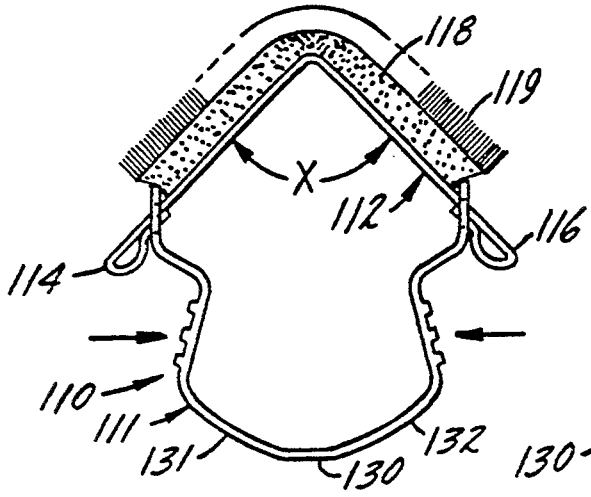
FIG. 14 is an end view of the pad-type painting tool of FIG. 9 after the handle has been flexed to cause the pad assembly to conform to an interior corner junction.
Figure 15:
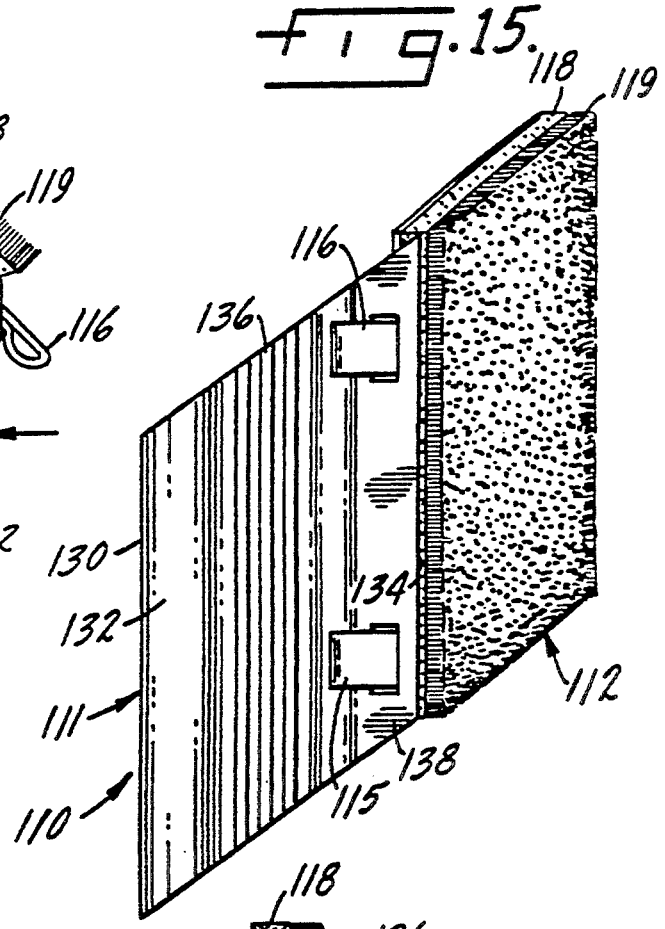
FIG. 15 is a side view of the pad-type painting tool of FIG. 9 as it appears when operated to paint an interior corner junction as shown in FIG. 14.

To apply paint to an inside, that is, an interior, corner area, the handle 111 is grasped by the ribbed areas 135, 136 and squeezed, as shown by the arrows in FIG. 14. Simultaneously, the user presses on the pad assembly 112 at pressure area 127, see FIG. 9, or in that general location, to ensure that the pad element bends as shown in FIGS. 14 and 15. At this point, the loaded tool can be used to apply paint into an inside, two-plane corner. By squeezing more or less, the pad structure angle X can be varied to fit the specific corner to be painted. The paint application is then accomplished by sliding the contacting tool back and forth along the corner junction as shown in FIG. 15.

Figure 16:
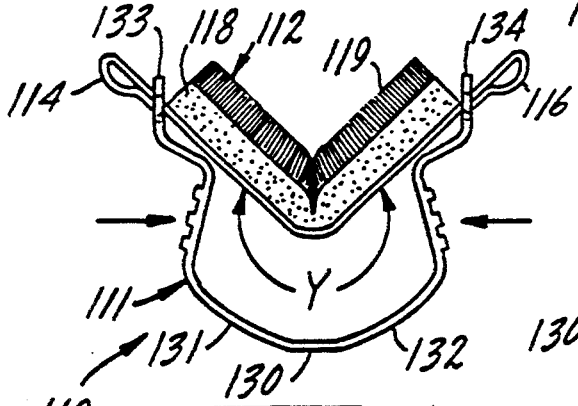
FIG. 16 is an end view of the pad-type painting tool of FIG. 9 after the handle has been flexed to cause the pad assembly to conform to an exterior corner junction.
Figure 17:
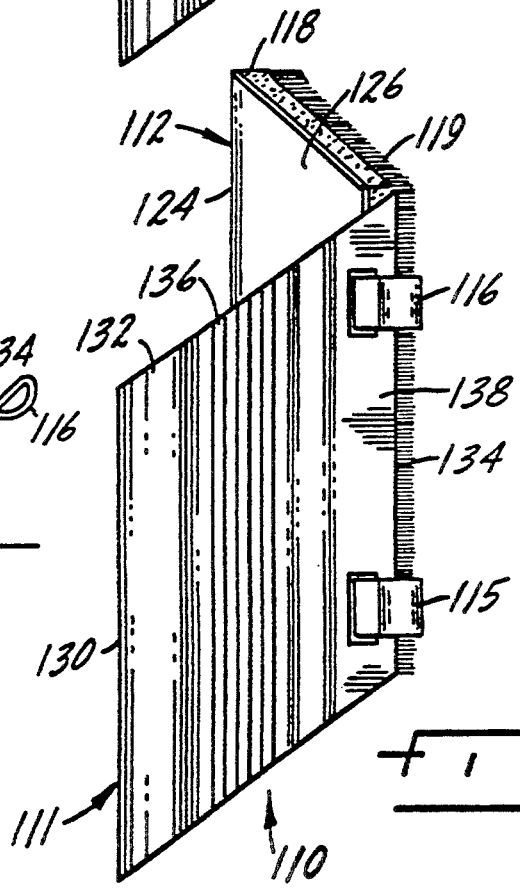
FIG. 17 is a side view of the pad-type painting tool of FIG. 9 as it appears when operated to paint an exterior corner junction as shown in FIG. 16.

To apply paint to an outside two-plane corner area, that is an exterior corner, the center of the pad assembly 112 which has been loaded with paint, is pressed against the outside corner and the handle 111 is squeezed, as shown schematically in FIG. 16 by the arrows. By squeezing more or less, the pad structure angle Y can be varied to fit the specific exterior corner to be painted. Again, paint application is accomplished by sliding the contacting tool back and forth along the corner junction with the parts of the tool in the position shown in FIG. 17.

To paint a flat surface, the paint applicator is used in the condition illustrated in FIG. 9 without the application of squeezing pressure on sides 131, 132, or finger pressure in area 127.

As will be appreciated from the foregoing description, the pad-type painting tools of this invention can paint flat surfaces, or interior or exterior corners of any angle, as contrasted to the fixed angle and fixed plane tools of the prior art, and is very easy to load with paint, as contrasted to angular prior art tools which require difficult and messy loading manipulations. The pad-type devices of this invention can be produced more efficiently and economically than the devices of the prior art since the flexible foam element of sheet 18, 118 can be glued to the backing 21, 121 in a flat orientation and in long sheets which are subsequently cut to size. Further, conventional pads require special fixturing to shape and glue pre-cut foam elements to conform to a specific degree profile for the tool, such as 90°. The instant invention, by contrast, is more efficient in design in that it utilizes replaceable pad elements; this results in better user value and convenience.

It should be noted that although living hinges 24, 124 and 130 as illustrated are of substantial widths, the width may vary to some extent. If the width is too small, the flexing action may be impeded. If the width is too large, a crease may form within the hinge material which is angled with respect to the center of the pad. Experience has shown that a hinge of about the illustrated size works well though, as mentioned, variation is possible.

Although two specific embodiments of the invention has been illustrated and described, it will at once be apparent to those skilled in the art that modifications may be made without departing from the spirit and scope of the invention. Accordingly it is intended that the scope of the invention be limited solely by the hereafter appended claims and not by the foregoing disclosure.

We claim:

1. A one-piece paint pad assembly whose painting surface contour is changeable from concave to flat to convex and all angles therebetween, and vice versa, by application of the pressure of one hand directly to the one-piece pad assembly, said one-piece paint pad assembly including a paint pad having a living hinge along the length of its mid-section to enable the paint pad to flex from concave to flat to convex, and all angles therebetween, and vice versa, and two handpieces each handpiece connected to the opposite side edges of the paint pad, the handpieces being graspable by one hand of a user and being adapted, upon application of squeezing pressure exerted by one hand of the user directly on the handpieces, to flex the one-piece paint pad so as to cause the paint pad to conform to the surface or surfaces being painted.

2. The one-piece paint pad assembly of claim 1, further characterized in that the paint pad extends forwardly of the handpieces in all relative positions of the paint pad and the handpieces a distance sufficient to enable one finger pressure from one hand of the user to be applied directly to the back of the paint pad to push the paint pad away from the handpieces while the user grasps the paint pad assembly with one hand to thereby cause the paint pad to flex to a convex configuration.

3. The one-piece paint pad assembly of claim 2, further characterized in that the pad means is a unitary, multi-layered structure, the lower most layer being fiber, the uppermost layer being a structure having a hinge extending the length thereof whereby the contour of the pad means can be changed in longitudinal cross section from convex to concave.

4. The one-piece paint pad assembly of claim 3, further characterized in that the uppermost layer includes two stiff side members joined by the hinge, said hinge being more flexible than the flanking side members, said hinge and the flanking side members being formed as a unitary part.

5. The one-piece paint pad assembly of claim 4, further characterized by and including an intermediate backing layer located between the uppermost layer and the fiber layer, said intermediate layer being sufficiently flexible to reflect the change in contour of the uppermost layer by the externally applied forces.

6. The one-piece paint pad assembly of claim 5, further characterized in that the intermediate layer is formed from plastic foam.

7. A two-piece paint pad assembly whose painting surface contour is changeable from concave to flat to convex and all angles therebetween, and vice versa, by application of the pressure to one of said two pieces, said two-piece paint pad assembly including a paint pad having a living hinge along the length of its mid-section to enable the paint pad to flex from concave to flat to convex, and all angles therebetween, and vice versa, and a flexible one-piece handle which is hingedly connected to the opposite side edges of the paint pad, the handle being graspable by one hand of a user and being adapted, upon application of squeezing pressure exerted by one hand of the user directly on the handle, to flex the one-piece paint pad so as to cause the paint pad to conform to the surface or surfaces being painted, the paint pad being a unitary, multi-layered structure, the lower most layer being fiber, the uppermost layer being a structure having a hinge extending the length thereof whereby the contour of the pad means can be changed in longitudinal cross section from convex to concave.

8. The two-piece paint pad assembly of claim 7, further characterized in that the uppermost layer includes two stiff side members joined by the hinge, said hinge being more flexible than the flanking side members, said hinge and the flanking side members being formed as a unitary part.

9. The two-piece paint pad assembly of claim 8, further characterized by and including an intermediate backing layer located between the uppermost layer and the fiber layer, said intermediate layer being sufficiently flexible to reflect the change in contour of the uppermost layer by the externally applied forces.

10. The two-piece paint pad assembly of claim 9, further characterized in that the intermediate layer is formed from plastic foam.

11. A paint pad assembly whose painting surface contour is changeable from concave to flat to convex and all angles therebetween, and vice versa, by application of the pressure of to the assembly, said assembly including a paint pad having a living hinge along the length of its mid-section to enable the paint pad to flex from concave to flat to convex, and all angles therebetween, and vice versa, and at least one handle connected to the opposite side edges of the paint pad, the handle being graspable by one hand of a user and being adapted, upon application of squeezing pressure exerted by one hand of the user directly on the handle, to flex the one-piece paint pad so as to cause the paint pad to conform to the surface or surfaces being painted, the pad means is a unitary, multi-layered structure, the lower most layer being fiber, the uppermost layer being a structure having a hinge extending the length thereof whereby the contour of the pad means can be changed in longitudinal cross section from convex to concave.

12. The paint pad assembly of claim 11, further characterized in that the uppermost layer includes two stiff side members joined by the hinge, said hinge being more flexible than the flanking side members, said hinge and the flanking side members being formed as a unitary part.

13. The paint pad assembly of claim 12, further characterized by and including an intermediate backing layer located between the uppermost layer and the fiber layer, said intermediate layer being sufficiently flexible to reflect the change in contour of the uppermost layer by the externally applied forces.

14. The paint pad assembly of claim 13, further characterized in that the intermediate layer is formed from plastic foam.

* * * * *